US006527570B1

(12) United States Patent
Hartman et al.

(10) Patent No.: US 6,527,570 B1
(45) Date of Patent: Mar. 4, 2003

(54) QUICK-RELEASE APPLIANCE CORD ASSEMBLY

(75) Inventors: Gary James Hartman, Chippewa Falls, WI (US); Richard Louie Geissler, Chippewa Falls, WI (US)

(73) Assignee: National Presto Industries, Inc., Eau Claire, WI (US)

( * ) Notice: Subject to any disclaimer, the term of this patent is extended or adjusted under 35 U.S.C. 154(b) by 0 days.

(21) Appl. No.: 09/970,521

(22) Filed: Oct. 3, 2001

(51) Int. Cl.[7] ..... H01R 13/62
(52) U.S. Cl. ..... 439/180; 439/39
(58) Field of Search ..... 439/39, 180

(56) References Cited

U.S. PATENT DOCUMENTS

| | | | | |
|---|---|---|---|---|
| 2,170,287 | A | 8/1939 | Kinnebrew | 439/39 |
| 2,792,557 | A | 5/1957 | Dowick | 439/105 |
| 2,792,561 | A | 5/1957 | Cohen | 439/652 |
| 3,321,730 | A | 5/1967 | Schlangen | 439/39 |
| 3,363,214 | A | 1/1968 | Wright | 439/39 |
| 3,431,428 | A | 3/1969 | Van Valer | 307/10.1 |
| 3,521,216 | A | 7/1970 | Tolegian | 439/39 |
| 3,786,391 | A | 1/1974 | Mathauser | 439/39 |
| 3,808,577 | A | 4/1974 | Mathauser | 439/39 |
| 4,242,657 | A | 12/1980 | Chaillot | 335/207 |
| 4,317,969 | A | 3/1982 | Riegler et al. | 200/52 R |
| 4,647,120 | A | 3/1987 | Karabakakis | 439/39 |
| 4,874,316 | A | 10/1989 | Kamon et al. | 439/39 |
| 5,941,729 | A | 8/1999 | Sri-Jayantha | 439/505 |
| 6,007,363 | A | 12/1999 | Renk | 439/378 |
| 6,183,264 | B1 | 2/2001 | Harsanyi | 439/38 |
| 6,250,931 | B1 | 6/2001 | Mendelson | 439/39 |
| 6,267,602 | B1 | 7/2001 | Mendelson et al. | 439/39 |
| 2002/0016088 | A1 | 2/2002 | Mendelson et al. | 439/39 |

FOREIGN PATENT DOCUMENTS

| | | |
|---|---|---|
| DE | 39 04 708 C1 | 1/1990 |
| GB | 1 232 922 | 5/1971 |
| JP | 5-54932 | 3/1993 |
| JP | 5-205811 | 8/1993 |
| JP | 5-335051 | 12/1993 |
| JP | 09-170345 | 6/1997 |

OTHER PUBLICATIONS

Operating Instructions, Electric Dispensing Pot, CD–DEC30/DEC40, Zojirushi Corporation, 50 pages, front cover, back cover. No Date.
Four Color Photographs of Zojirushi Corporation Electric Dispensing Pot, 2 pgs. No Date.

*Primary Examiner*—Tulsidas Patel
(74) *Attorney, Agent, or Firm*—Merchant & Gould P.C.

(57) ABSTRACT

A quick-release plug assembly having a plug body and a socket body for receiving the plug body. Either the plug body or the socket body may include first and second contact posts, and the other may include corresponding first and second contacts spaced to electrically connect to the contact post when the plug body is coupled to the socket body along a coupling axis. The socket body includes outwardly diverging sidewalls and a bottom wall. One of the plug body or the socket body includes a magnet, and the other includes an attractive member which, due to the attraction of the magnet, removably couples the plug body to the socket body. The cord is received by the plug body through an opening in the plug body. The opening receives the cord from a direction which is at an angle relative to the coupling axis when the plug body is coupled to the socket body. The socket body may further include a vertical ridge located so that when the plug body is coupled to the socket body, the ridge contacts a front surface of the plug body at a point spaced inwardly from side surfaces of the plug body and thereby provides a fulcrum about which the plug body may pivot to remove the plug body from the connection location.

23 Claims, 8 Drawing Sheets

QUICK-RELEASE APPLIANCE CORD ASSEMBLY

FIELD OF THE INVENTION

The present invention relates to appliances with electrical cords. Specifically, the present invention relates to appliances with magnetically coupled electrical cords.

BACKGROUND OF THE INVENTION

Many modern appliances such as kitchen appliances are electrically powered. Typically, electrical appliances are connected to a power outlet by means of a power cord. The appliances define a plug socket for receiving a removable plug at one end of the power cord. Preferably, the removable plugs are quickly and easily detachable and yet still maintain a reliable electrical connection when coupled to the appliance. There is a need for quick-releasing power cord plugs which reduce the amount of force necessary to detach the cord from the appliance when the cord is subjected to a pulling force. Moreover, the pulling force may be directed in a variety of directions. The plug and socket arrangement, therefore, preferably will be quick-releasing when the cord is pulled away from the appliance in different directions. Accordingly, improvements in constructing a quick-release cord assembly for appliances are desired.

SUMMARY OF THE INVENTION

One aspect of the present invention relates to a plug assembly having a plug body and a socket body for receiving the plug body. Either the plug body or the socket body may include first and second contact posts, and the other may include corresponding first and second contacts spaced to electrically connect to the contact post when the plug body is coupled to the socket body along a coupling axis. The socket body includes outwardly diverging sidewalls. One of the plug body or the socket body includes a magnet, and the other includes an attractive member which, due to the attraction of the magnet, removably couples the plug body to the socket body. The cord is received by the plug body through an opening in the plug body. The opening receives the cord from a direction which is at an angle relative to the coupling axis when the plug body is coupled to the socket body.

Another aspect of the present invention relates to a quick-release plug assembly including an appliance defining a connection location for coupling a plug body of a cord to the appliance. Either the connection location or the plug body includes first and second contact posts, and the other defines corresponding first and second contacts spaced to connect to the contact posts when the plug body is coupled to the connection location of the appliance. Either the connection location or the plug body includes a magnet, and the other includes an attraction member so that a magnetic force between the magnet and the attraction member couples the plug body to the connection location of the appliance. The connection location further includes a ridge, the ridge being located so that when the plug body is coupled to the connection location the ridge contacts a front surface of the plug body at a point spaced inwardly from side surfaces of the plug body and thereby provides a fulcrum about which the plug body may pivot to remove the plug body from the connection location.

An additional aspect of the present invention relates to an appliance and cord assembly having a magnetic plug body wherein the appliance defines a connection location for coupling the appliance to the magnetic plug body of the cord, and at least one base pad which supports the appliance. The base pad extends downward from a bottom of the appliance. The appliance also includes a base skirt located toward an outside of the appliance relative to the base pad. The skirt extends downwardly only a portion of the height of the base pad.

A further aspect of the present invention relates to an electrical cord plug assembly for a cord having two conductive leads. The assembly includes a plug body having first and second opposed housing members. The first and second housing members are coupled to each other by a fastener. The first and second housing members together define lead paths which receive the conductive leads of the cord. The lead paths lie in a common plane. The first and second housing members also define a cord channel in communication with the lead paths for receiving the cord. The cord channel is positioned at an angle relative to the plane of the lead paths. The assembly also includes a magnet disposed between the first and second housing members, first and second extension arms positioned along opposite sides of the magnet, the extension arms extending from inside the plug body to outside the plug body through slots defined by a front surface of the plug body, and two conducting contacts positioned between the first and second housing members, the contacts being electrically connected to the conductive leads of the cord, the contacts being accessible through first and second contact apertures defined by the front surface of the plug body.

The above summary of the present invention is not intended to describe each illustrated embodiment or every implementation of the present invention. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which:

FIG. 1 is a cross sectional top view along line B—B of FIG. 2.

Figure 1:
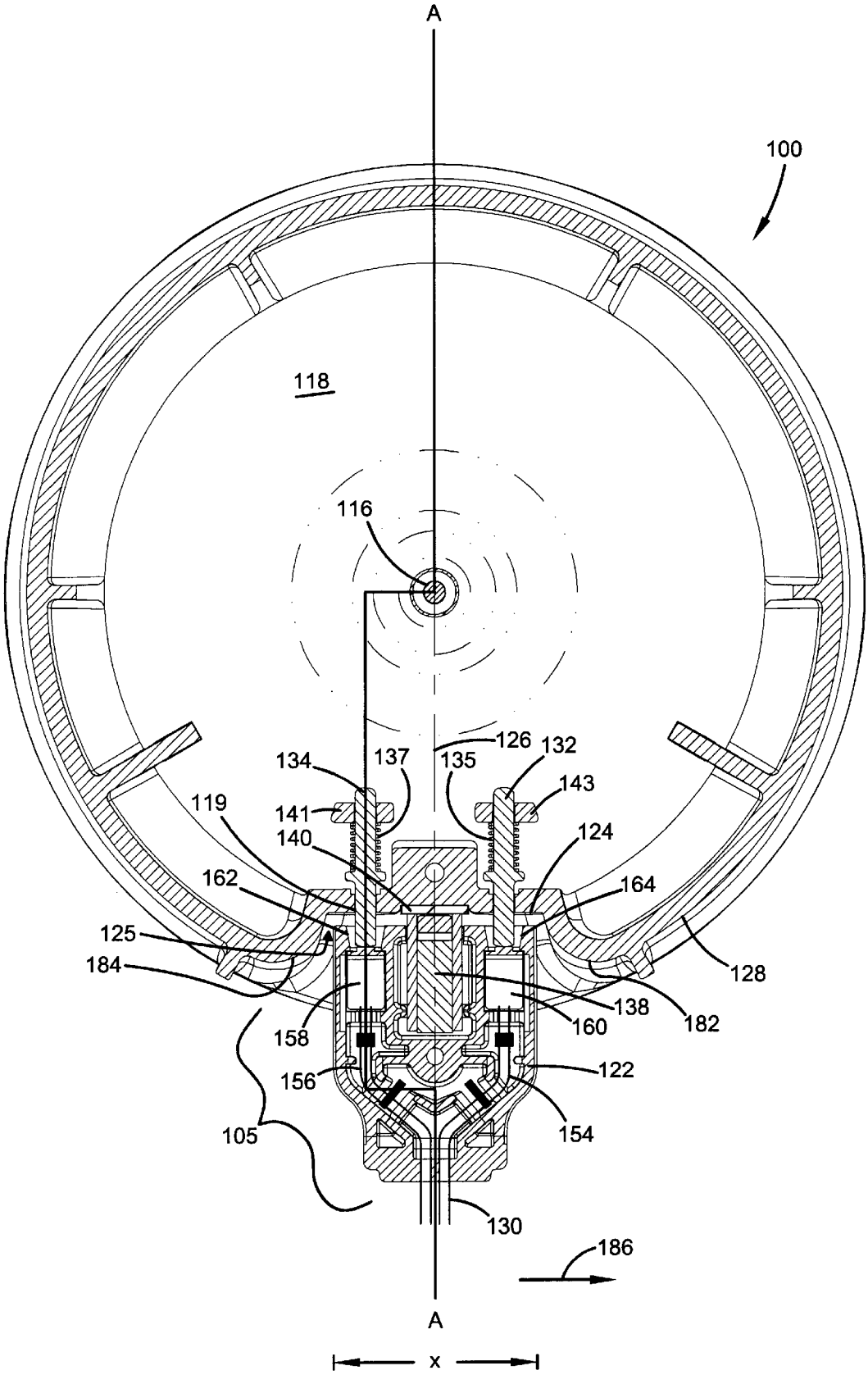
FIG. 1 is a cross-sectional top view of a first embodiment of a deep fryer appliance incorporating a quick-release plug assembly according to the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention relates generally to electrical appliances. The invention is particularly suited to appliances using a power cord to supply electric current to the appliance. An appreciation of various aspects of the invention will be gained through an understanding of the examples provided below.

Figure 2:
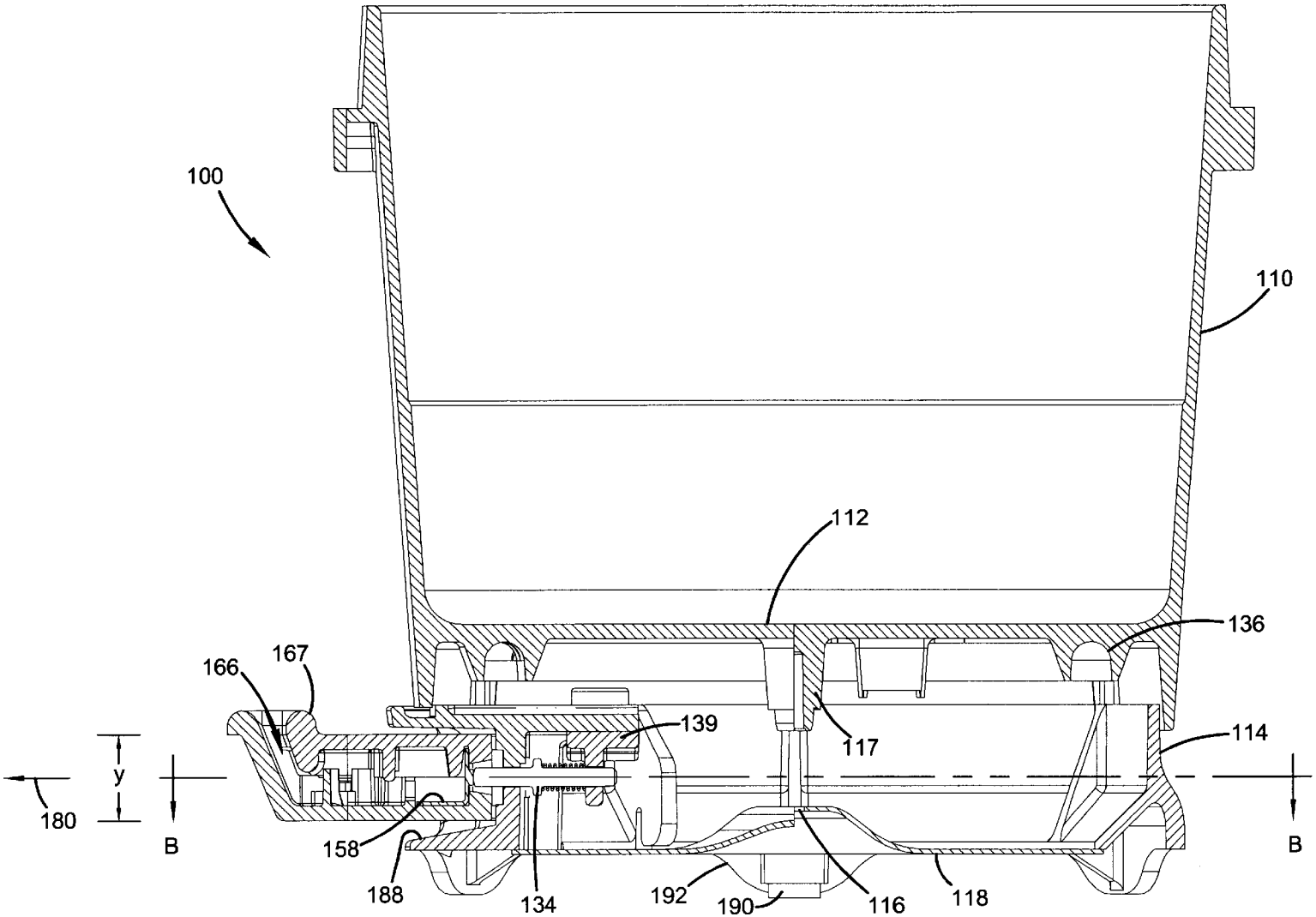
FIG. 2 is a cross-sectional side view of the deep fryer appliance of FIG. 1 along line A—A.
Figure 3:
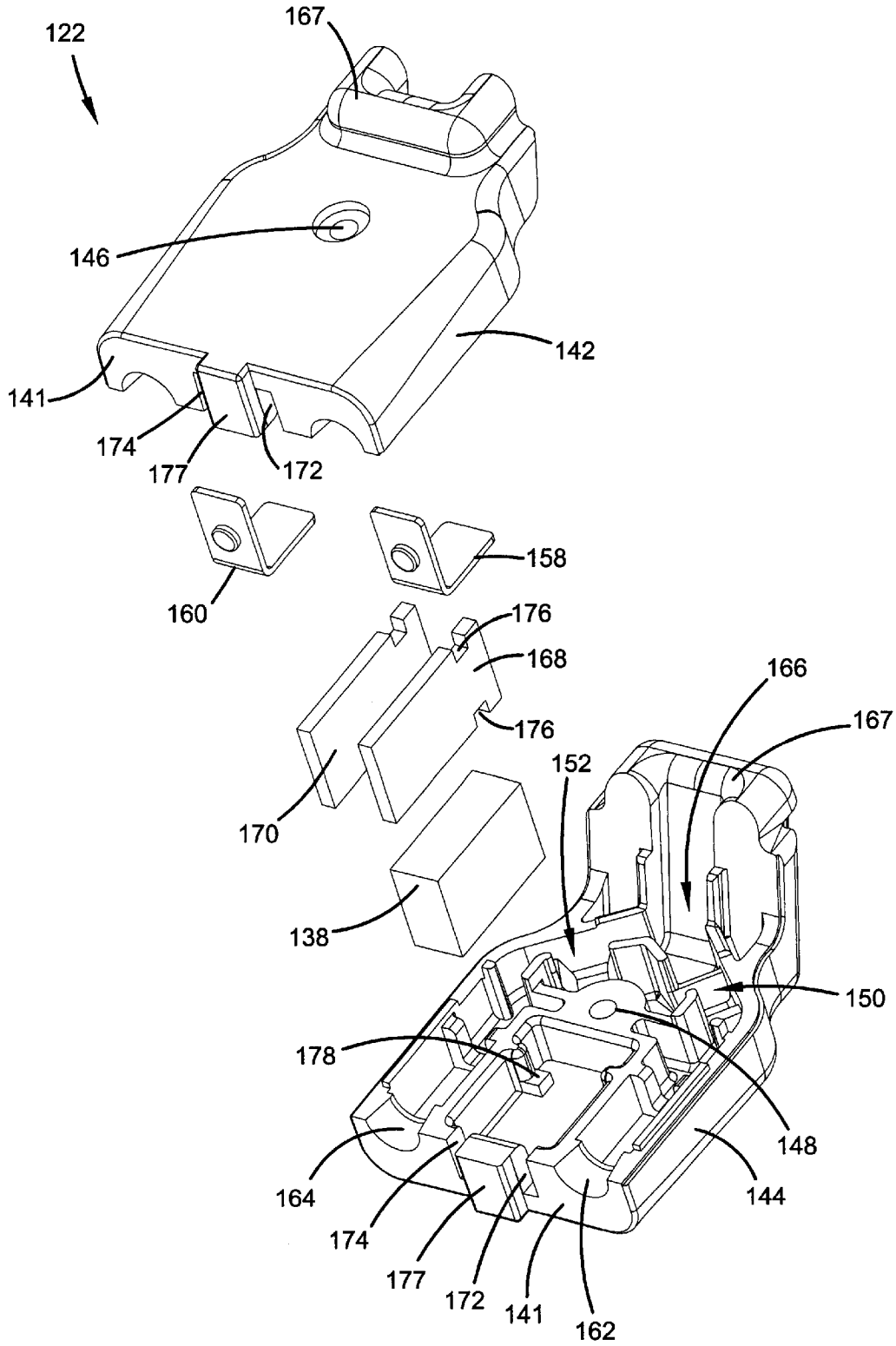
FIG. 3 is a perspective exploded view of a plug assembly according to the present invention.
Figure 4:
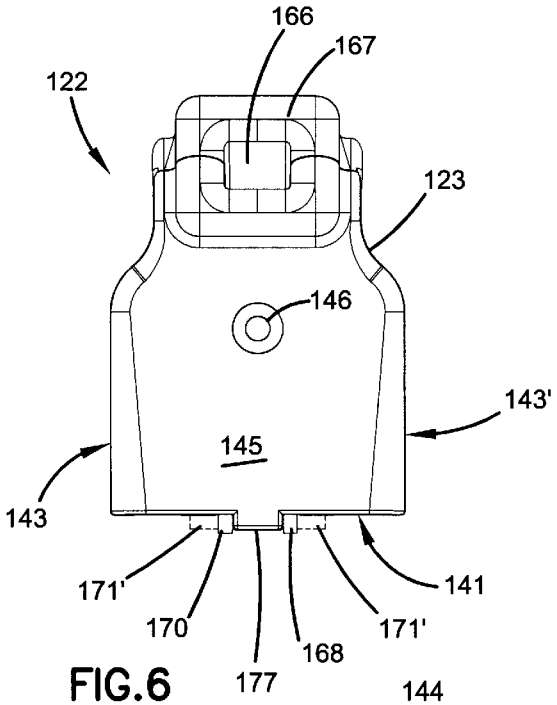
FIG. 4 is a top view of the assembly of FIG. 3 after assembly.
Figure 5:
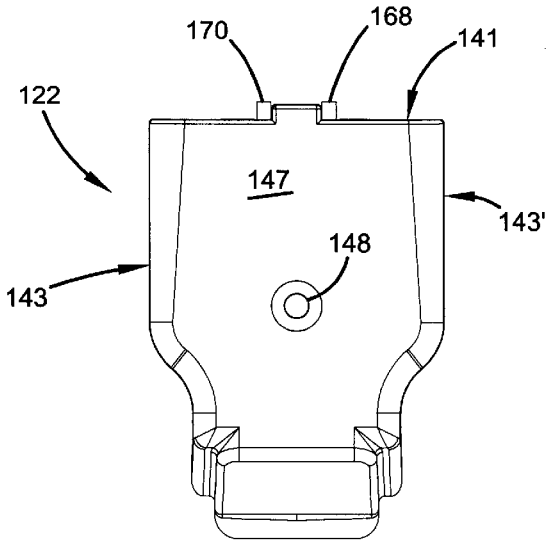
FIG. 5 is a bottom view of the plug assembly of FIG. 4.
Figure 6:
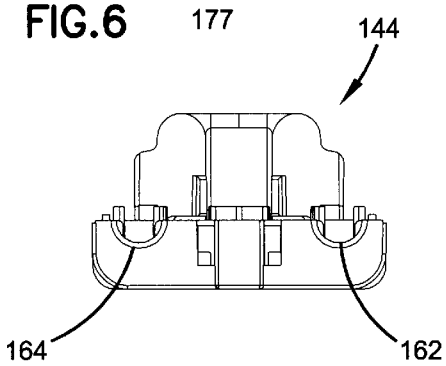
FIG. 6 is a front view of the lower housing member included in FIG. 3.
Figure 7:
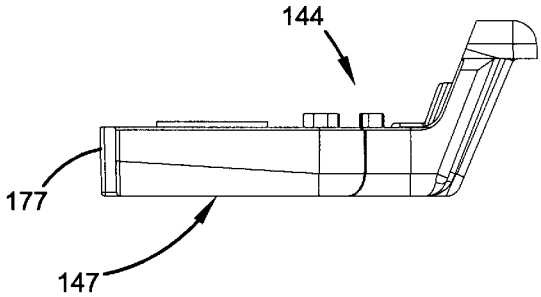
FIG. 7 is a side view of the lower housing member of FIG. 6.
Figure 8:
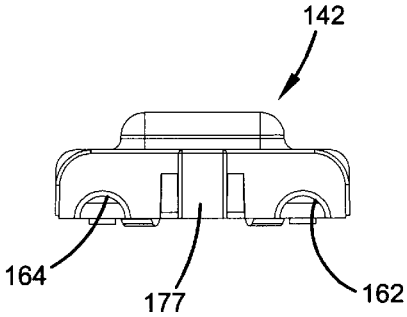
FIG. 8 is a front view of the upper housing member included in FIG. 3.
Figure 9:
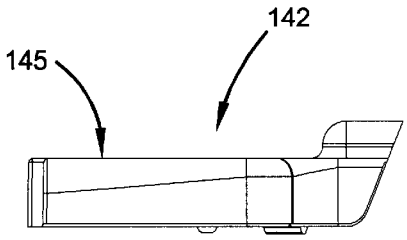
FIG. 9 is a side view of the upper housing member of FIG. 8.
Figure 10:
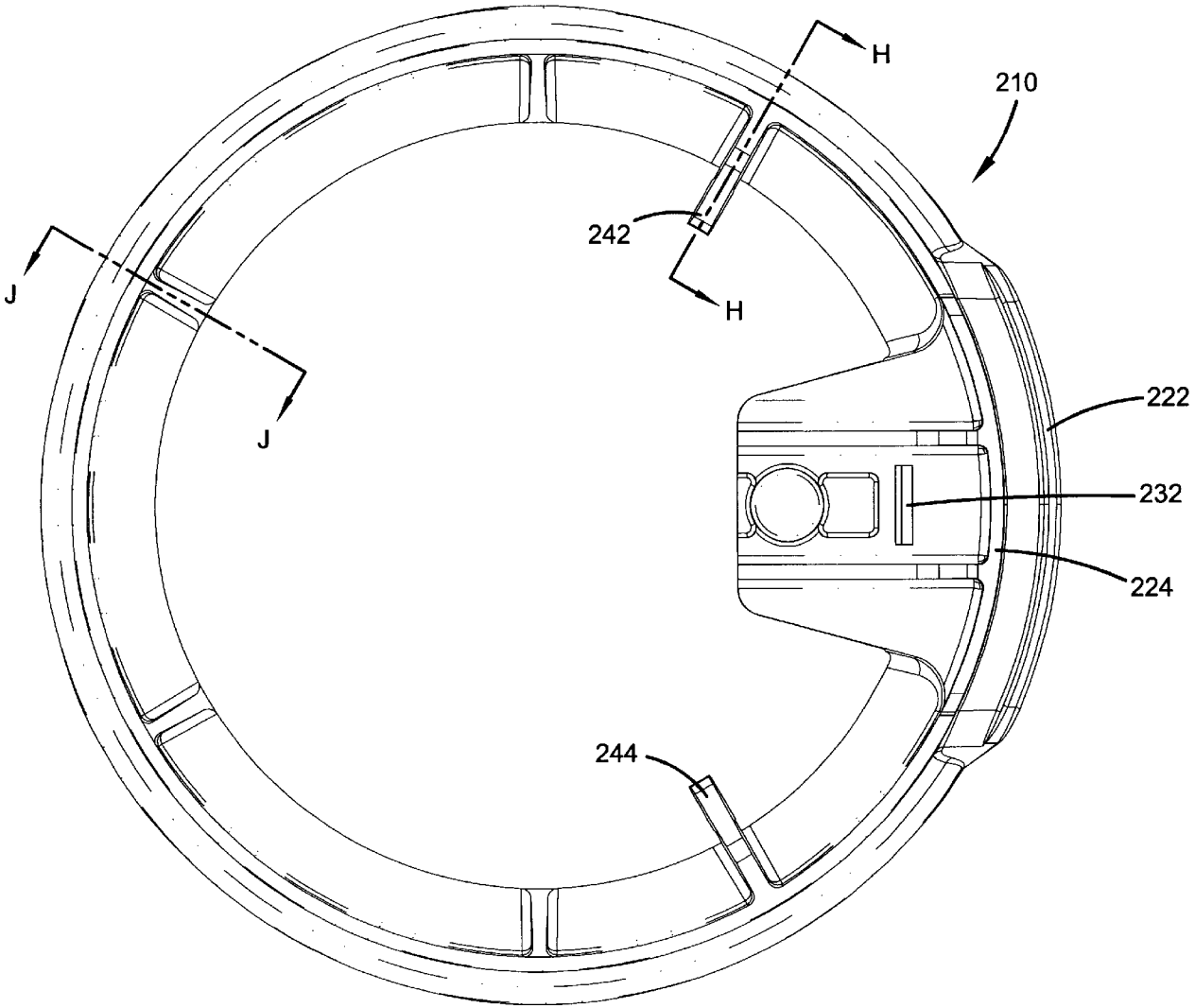
FIG. 10 is a top view of an alternative embodiment of an appliance base incorporating a socket body according to the present invention.

FIGS. 1 and 2 illustrate a deep fryer 100 incorporating a plug and connection location assembly 105 according to the present invention. Deep fryer 100 includes an upper portion 110 defining an oil basin 112. Upper portion 110 rests on the base 114. Base 114 is secured to the upper portion 110 by a fastener (not shown) inserted through a cover plate 118 which defines a center hole 116. The fastener is received into a center post 117 which extends from a bottom of the upper portion 110.

The base 114 includes a plug and connection location assembly 105 having a mating plug 122 and connection location 124. In the preferred embodiment shown in the Figures the connection location 124 is recessed from an outer wall 128 of the fryer base 114 to form a socket having a socket chamber 125. The connection location 124 receives plug 122 along coupling axis 126.

The plug 122 and connection location 124 electrically couple power cord (depicted schematically as 130) to contact posts 132 and 134 received through post apertures 119 in base 114. Contact posts 132 and 134 are coupled by wires to a heating element (not shown) disposed in circular groove 136 beneath the oil basin 112. Contact posts 132 and 134 are spring-loaded via springs 135 and 137. The springs 135 and 137 bias the contact posts 132 and 134 against contacts 158 and 160 located inside the plug 122 when the plug 122 is coupled to the connection location 124. Contact posts 132 and 134 are held in position by a mounting piece 139 which defines two ring structures 141 and 143 for receiving the contact posts 132 and 134 and holding the contact posts in horizontal alignment with the post apertures 119.

Plug 122 includes a magnet 138 which by magnetic force exerted on an attraction member 140 disposed in the connection location 124 releasably couples the plug 122 to the connection location 124. The attraction member 140 may be any material attracted to a magnetic force, for instance, ferromagnetic metals.

FIGS. 3–9 further illustrate plug 122 and its components. Plug 122 includes a plug body 123 having an upper housing member 142 and an opposing lower housing member 144. The plug body includes a front surface 141 and sides 143 and 143'. The plug body has a width "x" measured from side 143 to side 143' and a height "y" measured from top surface 145 to bottom surface 147. The width is approximately twice the height. The upper and lower housing members 142 and 144 each define a fastener aperture 146 and 148 for receiving a fastener (not shown). The fastener couples the upper housing member 142 to lower housing member 144. The upper and lower housing members 142 and 144 together define lead paths 150 and 152 which receive two conductive leads 154 and 156 (shown in FIG. 1) of cord 130. The lead paths 150 and 152 both lie in a common plane which is parallel to the coupling axis 126. The conductive leads 154 and 156 are electrically connected to L-shaped contacts 158 and 160 disposed within the plug 122. Contacts 158 and 160 are accessible through contact apertures 162 and 164. The contact apertures 162 and 164 receive contact posts 132 and 134 to establish an electrical connection between contacts 158 and 160 and contact posts 132 and 134. The contact apertures 162 and 164 are flared outward to prevent the contact posts 132 and 134 from binding inside the apertures 162 and 164 as the plug 122 is pulled or pivoted away from the connection location 124.

Plug 122 further includes ferromagnetic extension arms 168 and 170 positioned along opposite sides of magnet 138. The extension arms 168 and 170 extend from inside the plug 122 to outside the plug through slots 172 and 174 defined in the front surface 141. The extension arms 168 and 170 transmit the magnetic force of the permanent magnet 138. The extension arms 168 and 170 contact the attraction member 140 to couple the plug 122 to the connection location 124 via the magnetic force of the magnet 138. The extension arms define notches 176 which receive bosses 178 on the upper and lower housing members 142 and 144 to position and retain the extension arms inside the plug 122. The upper and lower housing members 142 and 144 include a protrusion 177 between slots 172 and 174 and extending beyond the front surface 141. The protrusion 177 may be widened to extended on both sides of the extension arms 168 and 170 in order to extend the fulcrum point of the plug and to increase the strength of the plug. A widened protrusion 177' is shown in broken lines on FIG. 4.

Lead paths 150 and 152 communicate with cord channel 166 defined by the upper and lower housing members 142 and 144. Cord channel 166 is an opening in the plug body through which the plug body receives the cord 130. At one end of the cord channel 166 the plug body includes a rounded collar 167. Significantly, the cord channel 166 in plug 122 is set at an upward angle relative to the plane occupied by the lead paths 150 and 152. By angling the cord channel 166 relative to the plane of the lead paths 150 and 152 and therefore the coupling axis 126, the plug will be released from the connection location by application of less force than if the cord channel 126 were not angled. The force of the magnet 138 is more difficult to overcome if the magnet 138 is pulled in a direction which is perpendicular to the surface to which it is attached, for instance, in the direction of arrow 180 in FIG. 2. By angling the cord channel 166 of plug 122, if the cord is pulled in the direction of arrow 180, the cord channel 166 creates a torquing action which pries the plug 122 away from the connection location 124. This torquing or rotating separation of the plug 122 from the connection location 124 can be accomplished with less force than would be required to pull the plug 122 straight off the connection location 124 without the angled cord channel 166.

The angled cord channel 166 being angled upwards is also significant. The cord channel 166 causes rotation of the plug 122 in a direction perpendicular to the plane occupied by the lead paths 150 and 152. In addition, as noted earlier, in the preferred embodiment shown in the figures the width "x" of plug 122 is greater than its height "y". When the cord 130 is pulled in a direction perpendicular to the connection location 124, for instance, in a direction parallel to the coupling axis 126 along arrow 180, the torquing action of the cord channel 166 pivots the plug 122 vertically, i.e. in the direction of its smaller profile. It is to be understood that plug 122 shown in the figures is included as an example and that the shape of plug 122 is not intended to limit the scope of the claims. For instance, the plug could have a variety of shapes including a square shape and still fall within the scope of the invention.

The connection location 124 of base 114 includes outwardly diverging, curved sidewalls 182 and 184. The outwardly diverging sidewalls 182 and 184 allow the plug 122 to pivot horizontally away from the connection location 124. Straight sidewalls would undesirably bind the plug inside the socket when the cord 130 pulls the plug 122 in a direction at a significant angle relative to the coupling axis 126. For instance, if cord 130 were pulled in the direction of arrow 186 in FIG. 1, straight walls may bind the plug 122 inside the socket and may not allow the plug 122 to be removed. By incorporating outwardly diverging sidewalls 182 and 184, the assembly 105 achieves quick-release in numerous directions. Similarly, the socket includes a downwardly angled bottom wall 188 which allows the plug 122 to pivot vertically as described above.

Base 114 also includes base pads or inserts 190. The base pads 190 extend from the bottom of the base 114 and support the base 114 when the base 114 is placed on a level surface. The base pads 190 may be any of various materials (such as rubber) which have a greater coefficient of friction than the plastic or metal materials commonly used to construct base 114. For example, the base pads 190 may be made of 50 durometer, oil resistant, non-marring, black nitrile or 65–75 durometer, oil resistant silicone. The base pads 190 aid in preventing the appliance from sliding when cord 130 is pulled. When the appliance is held stationary in this way, the plug 122 is more readily disconnected from the connection location 124. Therefore, the base pads 190 contribute to the quick-release function of the plug and connection location assembly 105.

The base 114 also includes base skirts 192. The base skirts extend downward from the base 114 and may be located adjacent the base pads 190 toward the outside surface of the base 114 relative to the base pads 190. The base skirts 192 have a lower coefficient of friction than the base pads 190. The base skirts 192 extend downward for only a portion of the height of the base pads 190 so that when the appliance 100 rests on a level table surface the base skirts 192 do not touch the table surface. If the appliance 100 begins to tip over, the base skirts 192 eventually are brought into contact with the table surface. Therefore, when the appliance begins to tip, the appliance may slide on the base skirts 192, and thereby reducing the likelihood of knocking the appliance completely over and spilling its contents. The base skirts 192 may also be spaced at intervals around the base 114 between the base pads 190.

Figure 11:
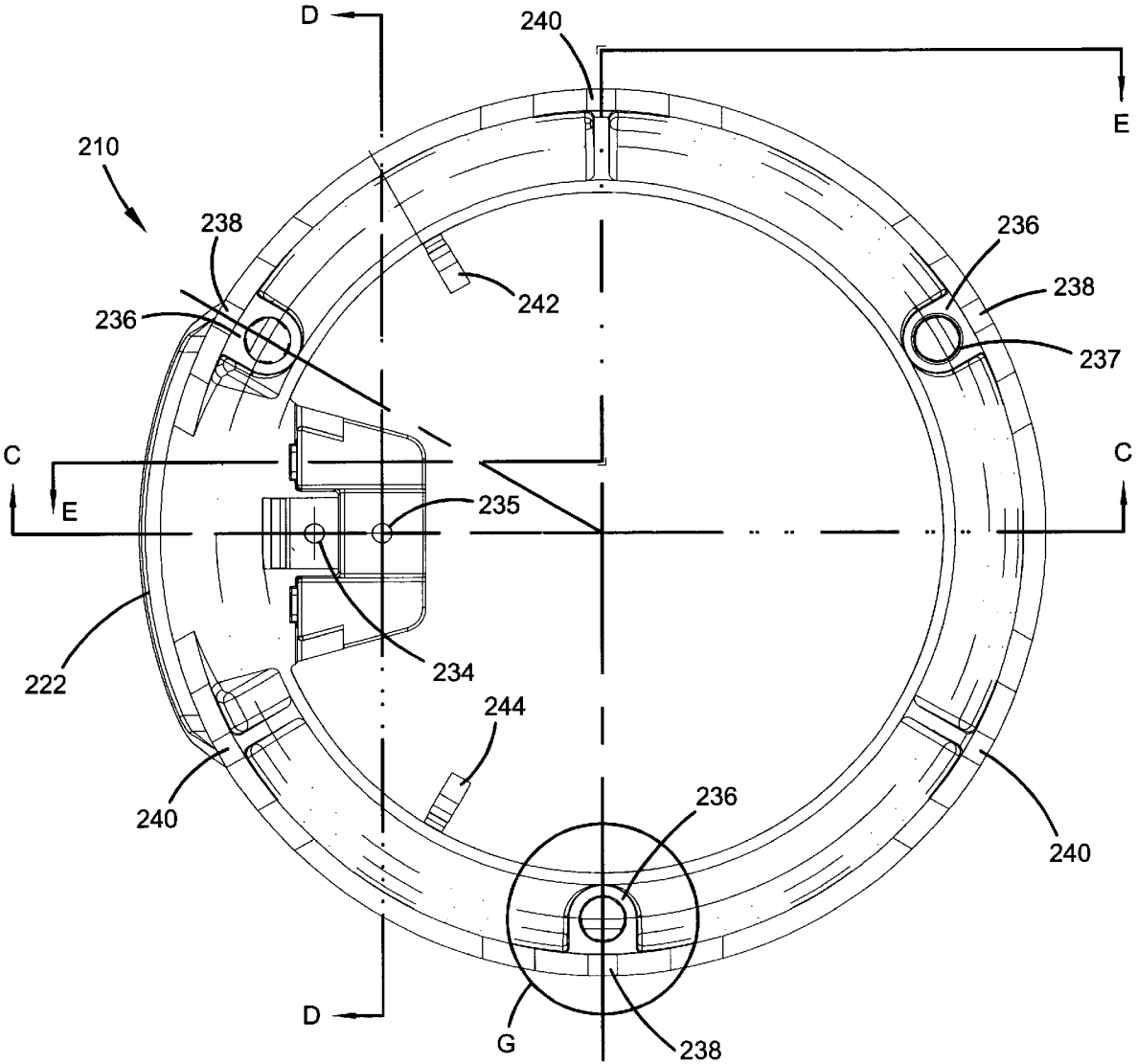
FIG. 11 is a bottom view of the appliance base of FIG. 10.
Figure 15:
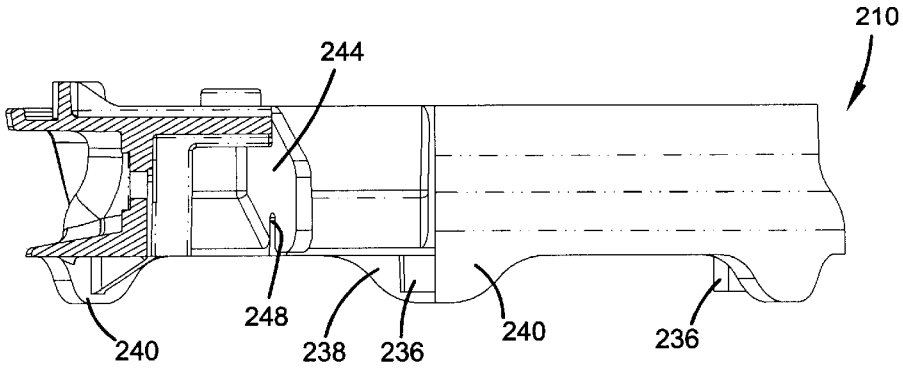
FIG. 15 is a cross-sectional view of the appliance base of FIG. 1 along line E—E.
Figure 14:
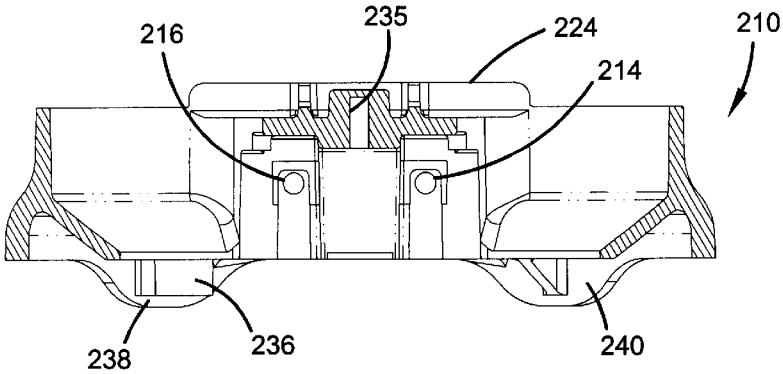
FIG. 14 is a cross-sectional view of the appliance base of FIG. 11 along line D—D.
Figure 13:
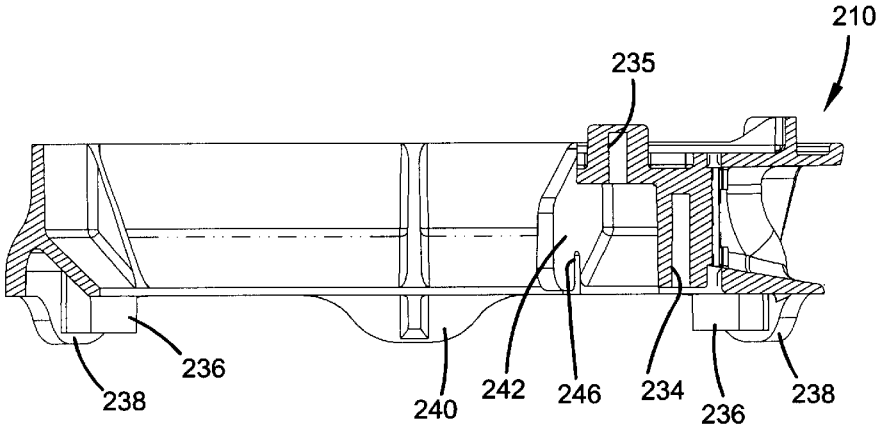
FIG. 13 is a cross-sectional side view of the appliance base of FIG. 11 along line C—C.
Figure 12:
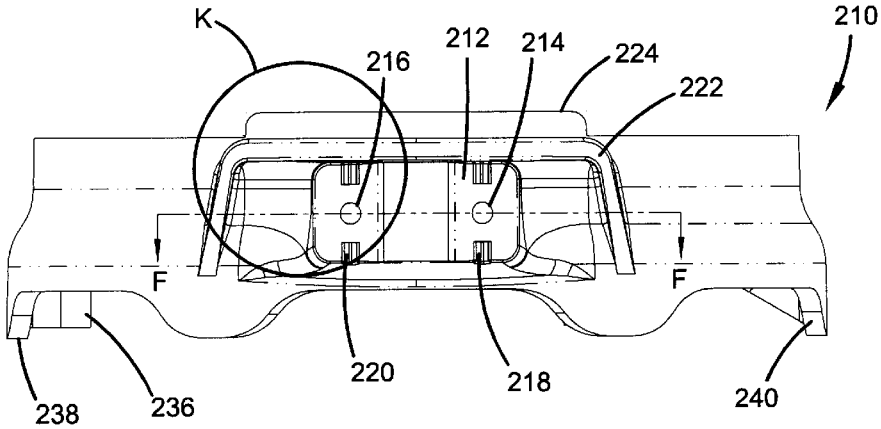
FIG. 12 is a front view of the appliance base of FIG. 10.

FIGS. 10–16 illustrate an alternative embodiment of a base 210 incorporating aspects of the present invention similar to base 114 of FIGS. 1–2. Referring now to FIG. 12, base 210 includes connection location 212. The connection location 212 includes post apertures 214 and 216 for receiving spring-loaded contact posts.

Figure 20:
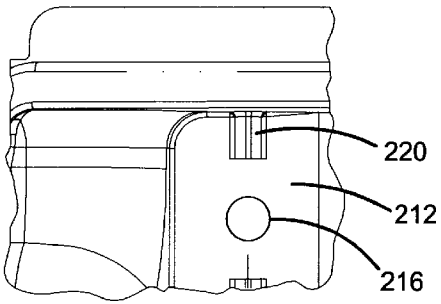
FIG. 20 is a detail view of portion K of FIG. 12.
Figure 19:
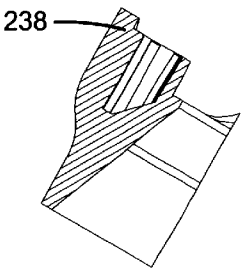
FIG. 19 is a cross-sectional view of FIG. 10 along line J—J.
Figure 18:
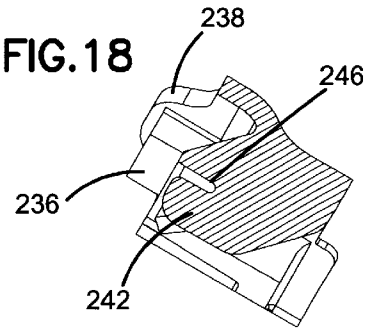
FIG. 18 is a cross-sectional view of FIG. 10 along line H—H.
Figure 16:
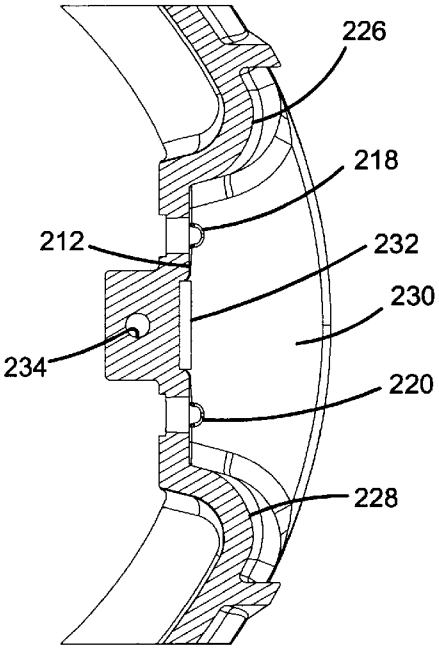
FIG. 16 is a partial cross-sectional view of FIG. 12 along line F—F.
Figure 17:
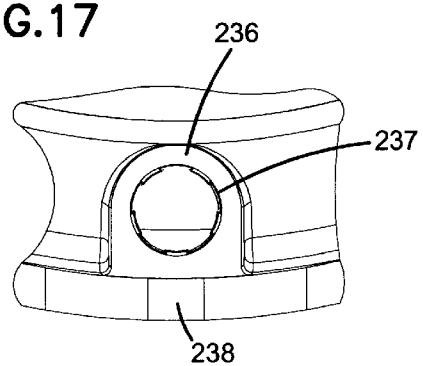
FIG. 17 is a detail view of portion G of FIG. 11.

Referring now to FIG. 20 which shows a detailed portion of FIG. 12, the connection location 212 includes vertical ridges 218 and 220. The vertical ridges 218 and 220 are located so that when a plug such as plug 122 is coupled to the connection location 212, the ridges 218 and 220 contact the front surface 141 of plug 122 at a point spaced inwardly from the sides of the plug 122. In this way, the vertical ridges 218 and 220 act as fulcrums about which the plug 122 may pivot to remove the plug 122 from the connection location 212. The ridges 218 and 220 in base 210 are intersected by the post apertures 214 and 216 so that each ridge includes an upper portion and a lower portion.

The connection location 212 includes outwardly extending sidewalls 226 and 228 as well as a downwardly angled bottom wall 230. The base 210 defines a vertical groove 232 for receiving an attraction member such as a metal plate. The base 210 may also define a securing aperture 234 for receiving a fastener to secure the attraction member to the base 210. Base 210 also defines mounting aperture 235 for securing a mounting piece (not shown) to the base 210 with a fastener. The mounting piece may include apertures for holding the contact posts in horizontal alignment with the post apertures 214 and 216.

Base 210 incorporates holder blocks 236 defining round receptacles 237 for receiving base pad inserts such as the base pads 190 from the first illustrated embodiment. The holder blocks 236 are each flanked by a base skirt 238. The base 210 includes additional base skirts 240 spaced around the base 210 between the base skirts 238.

Connection location 212 is shielded from oil and other undesirable substances by hood 222. The base 210 may also include a vertical drip guard 224. Base 210 also includes wire guides 242 and 244. Wire guides 242 and 244 define wire grooves 246 and 248 respectively. The wire guides 242 and 244 direct wires (not shown) from the contact posts to connection points on the heating element. The wire guides 242 and 244 hold the wires down and away form the heating element to prevent damage to the wires from the heating element.

It should be noted that the illustrated deep fryer appliance is provided by way of example and not of limitation. Other appliances may incorporate the present invention, such as skillets, cookers, and fondue pots. Accordingly, the present invention should not be considered limited to the particular examples described above, but rather should be understood to cover all aspects of the invention as fairly set out in the attached claims. Various modifications and numerous structures to which the present invention may be applicable will be readily apparent to those of skill in the art to which the present invention is directed upon review of the present specification. The claims are intended to cover such modifications and devices.

What is claimed is:

1. A quick-release plug assembly comprising:

a plug body defining an opening for receiving an end of a cord; and a socket body for receiving the plug body along a coupling axis, the socket body having outwardly diverging sidewalls;

wherein one of the socket body and the plug body include first and second contact posts, and the other of the socket body and the plug body defines corresponding first and second contacts spaced to connect to the contact posts when the plug body is coupled to the socket body;

wherein one of the socket body and the plug body include a magnet, and the other of the socket body and the plug body includes an attraction member so that a magnetic force between the magnet and the attraction member couples the plug body along the coupling axis to the socket body;

wherein the cord is received in the opening of the plug body from a direction which is at an angle relative to the coupling axis when the plug body is coupled to the socket body; and wherein the socket body includes a plurality of vertical ridges located so that when the plug body is coupled to the socket body the ridges contact a front surface of the plug body at a point spaced inwardly from side surfaces of the plug body and thereby provides a fulcrum about which the plug body may pivot to remove the plug body from the socket body.

2. The quick-release plug assembly of claim 1 wherein the contact posts extend from the socket body, and wherein the contact posts are spring-loaded.

3. The quick-release plug assembly of claim 1 wherein the opening defined by the plug body for receiving the cord is upwardly angled from the coupling axis.

4. The quick-release plug assembly of claim 1 wherein the sidewalls are curved.

5. The quick-release plug assembly of claim 1 wherein the magnet is disposed between the contacts.

6. The quick-release plug assembly of claim 1 wherein the socket body includes a downwardly angled bottom wall.

7. A quick-release plug assembly for electrically coupling an electric cord to an appliance, the assembly comprising:

a plug body which receives an end of the cord, the plug body having a front surface and side surfaces; and an appliance defining a connection location for coupling the appliance to the plug body;

wherein one of the connection location and the plug body include first and second contact posts, and the other of the connection location and the plug body defines corresponding first and second contacts spaced to connect to the contact posts when the plug body is coupled to the connection location of the appliance;

wherein one of the connection location and the plug body include a magnet, and the other of the connection location and the plug body includes an attraction member so that a magnetic force between the magnet and the attraction member couples the plug body to the connection location of the appliance;

wherein the connection location includes at least one ridge, the ridge being located so that when the plug body is coupled to the connection location the ridge contacts the front surface of the plug body at a point spaced inwardly from the side surfaces of the plug body and thereby provides a fulcrum about which the plug body may pivot to remove the plug body from the connection location.

8. The quick-release plug assembly of claim 7 wherein the ridge is vertical.

9. The quick-release plug assembly of claim 7 wherein the at least one ridge includes first and second vertical ridges.

10. The quick-release plug assembly of claim 9 wherein the first and second vertical ridges are intersected by the first and second contact posts respectively.

11. The quick-release plug assembly of claim 7 wherein the connection location includes outwardly diverging sidewalls.

12. The quick-release plug assembly of claim 7 wherein the contact posts extend from the connection location, and wherein the contact posts are spring-loaded.

13. The quick-release plug assembly of claim 7 wherein the plug body defines a channel opening for receiving the end of the cord, the channel opening being upwardly angled relative to the contact posts when the plug body is coupled to the connection location.

14. An appliance and cord assembly comprising:

an appliance defining a connection location for coupling the appliance to the cord, the appliance having at least one base pad which supports the appliance, the base pad having a height, the base pad extending downwards from a bottom of the appliance, the appliance also having a base skirt extending from the bottom of the appliance, the skirt located toward an outside of the appliance relative to the base the skirt extending downwardly only a portion of the height of the base pad;

a plug body which receives an end of the cord;

wherein one of the connection location and the plug body include first and second contact posts, and the other of the connection location and the plug body defines corresponding first and second contacts spaced to connect to the contact posts when the plug body is coupled to the connection location of the appliance;

wherein one of the connection location and the plug body include a magnet, and the other of the connection location and the plug body includes an attraction member so that a magnetic force between the magnet and the attraction member couples the plug body to the connection location of the appliance.

15. The assembly of claim 14 wherein the base skirt is located adjacent the base pad.

16. The assembly of claim 14 wherein the at least one base pad includes first, second and third base pads, each base pad supporting the appliance when the appliance is set on a level surface, each base pad having a height, each base pad extending downwards from a bottom of the appliance, and further wherein the base skirt is a first base skirt, the appliance including second and third base skirts extending from the bottom of the appliance, the first second and third base skirts located adjacent the first second and third base pads respectively and toward the outside of the appliance relative to the base pads, the base skirts extending downwardly only a portion of the height of the base pads.

17. An electrical cord plug assembly comprising:

an electrical cord having first and second ends, the cord having first and second conductive leads;

a plug body including first and second housing members, the first and second opposed housing members, the first and second housing members coupled to each other by a fastener, the first and second housing members together defining first and second lead paths which receive the conductive leads of the cord, the first and second lead paths lying in a common plane, the first and second housing members defining a cord channel for receiving the cord, the cord channel in communication with the lead paths, the cord channel disposed at an angle relative to the plane of the first and second lead paths;

a magnet disposed between the first and second housing members;

first and second extension arms positioned along opposite sides of the magnet, the extension arms extending from inside the plug body to outside the plug body through slots defined by a front surface of the plug body;

two conducting contacts positioned between the first and second housing members, the contacts being electrically connected to the conductive leads of the cord, the contacts being accessible through first and second contact apertures defined by the front surface of the plug body.

18. The electrical cord plug assembly of claim 17 wherein the contacts are L-shaped.

19. The electrical cord plug assembly of claim 17 wherein the extension arms define notches, and wherein one of the first and second housing members includes bosses received by the notches of the extension arms.

20. The electrical cord plug assembly of claim 17 wherein the plug body includes a rounded collar positioned around the cord channel.

21. The electrical cord plug assembly of claim 17 wherein the contact apertures flare outward from the contacts.

22. A quick-release socket for receiving a magnetic plug, the socket comprising:

a socket body defining a plug chamber and a plug axis for receipt of the magnetic plug, the chamber having two outwardly diverging sidewalls and a downwardly diverging bottom wall, the socket body defining two post apertures parallel to the plug axis;

two spring-loaded contact posts received by the post apertures of the socket body parallel to the plug axis;

an attraction member held by the socket body for attracting a magnetic member of the magnetic plug;

wherein the socket body includes a plurality of vertical ridges which provide a fulcrum about which the plug may pivot to remove the plug from the socket.

23. The quick-release socket of claim 22 wherein the plurality of vertical ridges are located so that when a plug is received in the socket, the ridges contact a front surface of the plug at points spaced inwardly from side surfaces of the plug.

* * * * *

UNITED STATES PATENT AND TRADEMARK OFFICE

CERTIFICATE OF CORRECTION

PATENT NO. : 6,527,570 B1
DATED : March 4, 2003
INVENTOR(S) : Hartman et al.

It is certified that error appears in the above-identified patent and that said Letters Patent is hereby corrected as shown below:

Column 3,
Line 7, "FIG. 1 along line E-E." should read -- FIG. 11 along line E-E. --

Column 8,
Line 20, "base the skirt" should read -- base pad, the skirt --

Signed and Sealed this

Ninth Day of December, 2003

JAMES E. ROGAN
*Director of the United States Patent and Trademark Office*